US005967341A

United States Patent [19]

Werner

[11] Patent Number: 5,967,341

[45] Date of Patent: Oct. 19, 1999

[54] CLIP STRIP HAVING FLEXIBLE TRAPEZOIDAL SHAPED INTERMEDIATE SUPPORT

[75] Inventor: Theodore J. Werner, Dix Hills, N.Y.

[73] Assignee: United States Marketing Corporation, Huntington Station, N.Y.

[21] Appl. No.: 08/911,161

[22] Filed: Aug. 14, 1997

[51] Int. Cl.[6] ..... A47F 7/00

[52] U.S. Cl. ..... 211/85.15; 211/71.01; 211/85.29; 248/316.5; 248/316.7

[58] Field of Search ..... 211/71.01, 85.15, 211/85.4, 85.29, 113; 248/316.5, 316.7

[56] References Cited

U.S. PATENT DOCUMENTS

| | | | |
|---|---|---|---|
| 2,116,386 | 5/1938 | Copeland | 211/85.15 |
| 2,454,857 | 11/1948 | Bish | 248/95 |
| 2,583,092 | 1/1952 | Dreyfus | 211/85.15 |
| 2,758,751 | 8/1956 | Gunderson | 221/81 |
| 3,967,346 | 7/1976 | Young | 211/89.01 |
| 4,291,810 | 9/1981 | Rubenstein | 211/89.01 |
| 4,461,387 | 7/1984 | Belokin | 211/85.15 |
| 5,158,186 | 10/1992 | Krut | 211/113 |
| 5,577,698 | 11/1996 | Liu et al. | 248/214 |

*Primary Examiner*—Daniel P. Stodola
*Assistant Examiner*—Gregory J. Strimbu
*Attorney, Agent, or Firm*—Charles E. Baxley, Esq.

[57] ABSTRACT

A clip strip is formed as a unitary member which includes an elongated panel and an array of clips mounted on flexible resilient supports which project from the panel. Pressing on a first end of one of the clips moves the opposite end of the chip away from the elongated panel allowing merchandise to be inserted between the opposite end of the clip and the elongated panel. The resilient action of the support returning toward its unstressed condition holds the merchandise to the elongated panel. Alternatively merchandise having apertures may be hung on the first end of the clips.

13 Claims, 3 Drawing Sheets

CLIP STRIP HAVING FLEXIBLE TRAPEZOIDAL SHAPED INTERMEDIATE SUPPORT

BACKGROUND OF THE INVENTION

1. Field of the Invention

The present invention relates generally to retail display units and more particularly to a clip strip which incorporates a flexible clip.

2. The Prior Art

Relevant prior art includes numerous devices among which are the devices shown in the following U.S. Patents.

U.S. Pat. No. 4,291,810 to Rubinstein shows a retaining assembly for packages which has a hollow support member having a front opening and a mounting bracket near the opening. A V-shaped clip has a back leg which passes through the opening and is compressed against a back wall of the support member. The clip includes a front member which is mounted pivotally on a mounting bracket. A front leg of the mounting bracket extends beyond the pivot point and is clamped against the support member by the back leg.

U.S. Pat. No. 4,573,590 to Ellis shows a clip strip display unit which has a row of flexible spring clips mounted on a vertical unit. The vertical unit includes a pair of oppositely directed flexible brackets which are proportioned to engage an edge of a shelf.

U.S. Pat. No. 5,096,070 to Jaynes shows a clip strip which incorporates a series of upwardly directed fingers which are designed to engage a hole in a bag of items to be supported. Adjacent each finger there is a pair of downwardly directed flaps which extend over a top of the bag and secure an upper edge of the bag to a backing sheet.

U.S. Pat. No. 4,461,387 to Belokin, Jr. shows an elongated steel support member which has a plurality of clips formed along its length. The clips are punched from the support member and are formed with an arcuate spring-like portion attached to the support member. An integral spring clip support assembly includes a base which holds a pair of support members in a vertical position. A wedging plug is inserted in the base and engages the support member to hold it tightly in the base.

U.S. Pat. No. 5,115,921 to Lavelle shows a display unit which includes an upright standard and branches carried by the standard end projecting laterally therefrom. The branches incorporate clips with each clip having a pair of jaws and a coil spring which urges the jaws toward a closed position.

U.S. Pat. No. 5,199,578 to Pendergraph et al. shows a display assembly which has a vertically disposed elongated planar strip of synthetic resin. A multiplicity of incisions are spaced along the strip with each incision having a pair of spaced, vertically extending legs and a transverse head portion. The incisions form upwardly extending tabs which are hinged to the planar strips. The tabs have horizontally extending ears which facilitate lodging the tabs in hanger apertures formed in blister cards.

U.S. Pat. No. 5,553,721 to Gebka shows a display unit made of plastic sheet which has W-shaped slits defining central fingers pointing to one end of the strip for suspending apertured products and outer fingers for suspending slotted products.

U.S. Design Pat. No. Des. 309,252 to Crowley shows a clip strip in which a plurality of clips are formed on a planar substrate by forming a plurality of W-shaped incisions in the substrate.

Despite developments of the prior art, there remains a need for a spring clip display unit which is economical to manufacture, easy to clean and which can be used easily to display merchandise which has apertures and also merchandise which does not have apertures.

SUMMARY OF THE INVENTION

It is an object of this invention to provide a clip strip which incorporates a plurality of spring clips which are integrally formed on a support member.

Another object of the present invention is to provide a clip strip in which spring clips have a plurality of teeth to grasp merchandise in a secure manner.

Another object of the present invention is to provide a clip strip in which spring clips are capable of holding merchandise which has apertures and also merchandise which does not have apertures.

Another object of the present invention is to provide a clip strip which facilitates the rapid stocking of merchandise for display.

Yet another object of the present invention is to provide a clip strip which can be manufactured economically using high speed plastic molding processes.

The foregoing and other objects and advantages of the present invention will appear more clearly hereinafter.

In accordance with the present invention there is provided a clip strip in which a flexible plastic clip is spaced outwardly from a planar support surface. The support surface defines an opening having a lower edge. The spring clip is provided with a lower end that projects into the opening close to the lower end of the opening. Merchandise can either be clipped between the lower end and the support surface, or the merchandise may be hung on the upper end of the spring clip.

DESCRIPTION OF THE DRAWINGS

Other important objects and advantages of the invention will be apparent from the following detailed description, taken in connection with the accompanying drawings, in which.

DEATILED DESCRIPTION OF THE INVENTION

With reference to the drawings, wherein like reference numbers designate same or corresponding parts throughout, there is shown in FIGS. 1–8 a clip strip having flexible intermediate support made in accordance with the present invention.

Figure 2:
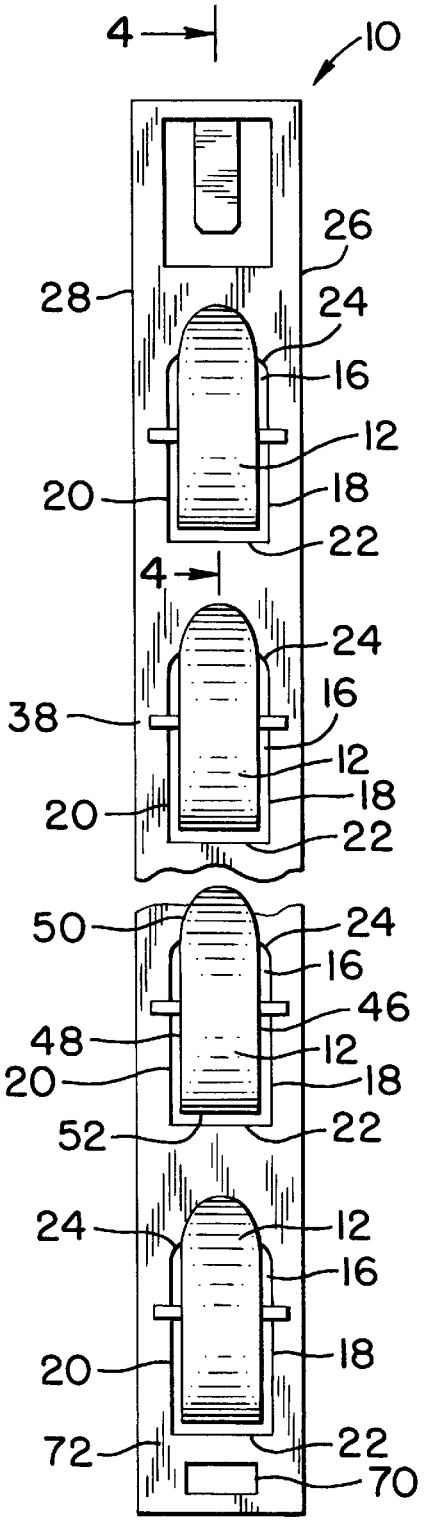
FIG. 2 is a front plan view of the clip strip of FIG. 1, taken along line 2—2 of FIG. 1.
Figure 3:
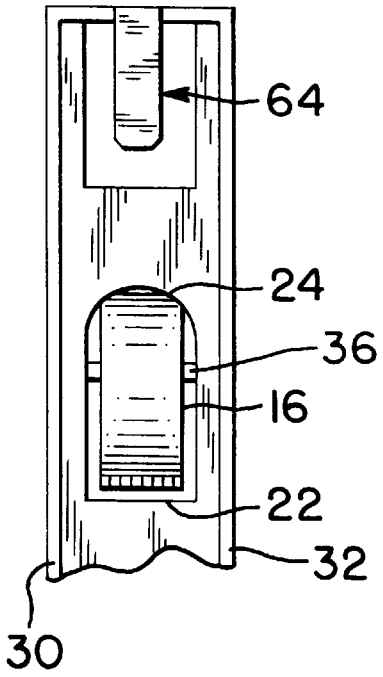
FIG. 3 is a fragmentary bottom plan view of the clip strip of FIG. 1, taken along line 3—3 of FIG. 1.

The clip strip 10 is an integrally formed unit in which a plurality of identical clip members 12 are formed on a planar support panel 14. As is shown in FIGS. 2 and 3, the support panel 14 includes a plurality of apertures 16. Each of the apertures 16 includes a pair of generally respectively parallel side edges 18, 20, a transverse lower edge 22, and a curved upper edge 24. Longitudinal edges 26, 28 of the support panel 14 are shown in FIG. 3 to be connected to integrally formed flanges 30, 32.

A lower edge 34 of a support plate 36 is formed integrally on an intermediate portion 38 of the support panel 14. The support plate 36 extends transversely across the aperture 16 between the side edges 18, 20.

Figure 1:
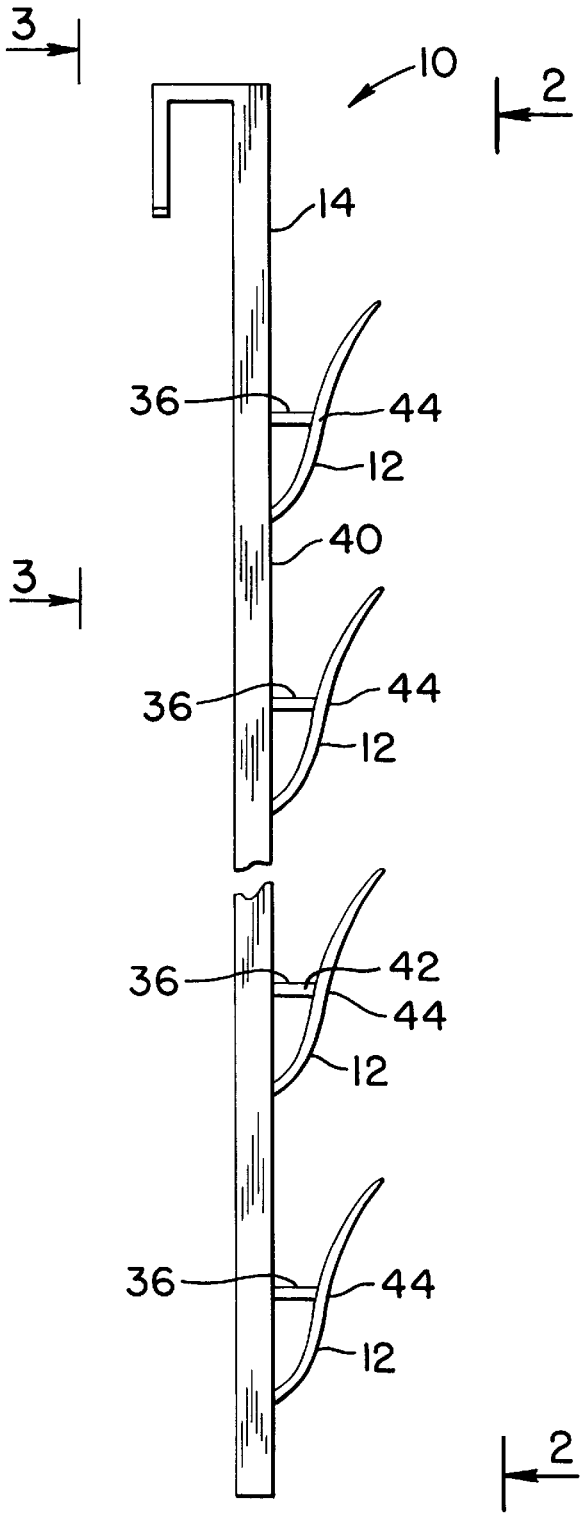
FIG. 1 is a side elevational view of a clip strip having flexible intermediate support made according to the present invention.

In the unflexed or unstressed condition, shown in FIG. 1, the support plate 36 is generally perpendicular to a surface 40 of the support panel 14. An upper portion 42 of the support plate 36 is connected integrally to intermediate portion 44 of the clip member 12.

The clip member 12 has side portions 46, 48 which are generally respectively parallel, an upper edge 50 and a lower edge 52 which preferably has a plurality of teeth 54 that can contact transverse lower edge 22. An upper portion 56 of the clip member 12 is concave when viewed from the direction shown by the arrow 58 in FIG. 4 and a lower portion 60 is convex when viewed from the direction of the arrow 58. In the unflexed condition, shown in FIGS. 1 and 4, the lower edge 52 of the clip member 12 projects snuggly below the surface 40 and rearwardly of an inner wall 15 of the support panel 14.

An upper end 62 of the support panel 14 includes an integrally formed hook 64 which projects from the support panel 14. The hook 64 includes a first portion 66 which is generally perpendicular to the support panel 14 and a second portion 68 which is generally parallel to the support panel 14. The hook 64 may be used to suspend the spring clip strip 10 from an edge of a shelf or some other suitable structure. The hook 64 may be used in conjunction with an aperture 70 formed in a lower portion 72 of a next clip strip 10 to attach the hook 64 of a first clip strip 10 to an aperture 70 of the next clip strip 10 to form a display of extended length. Other suitable means for connecting clip strips together in chain-like fashion are available.

Figure 7:
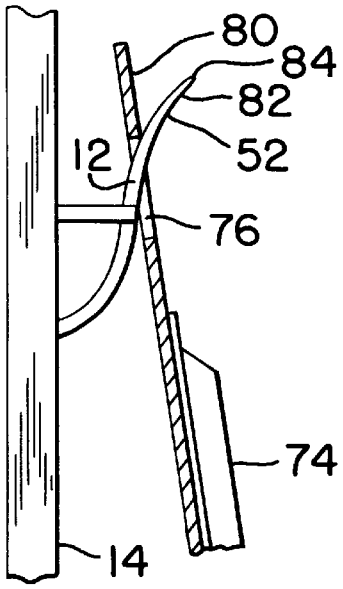
FIG. 7 is a fragmentary elevational view of the clip strip of FIG. 1, showing the apparatus in use, holding merchandise which has an aperture.
Figure 8:
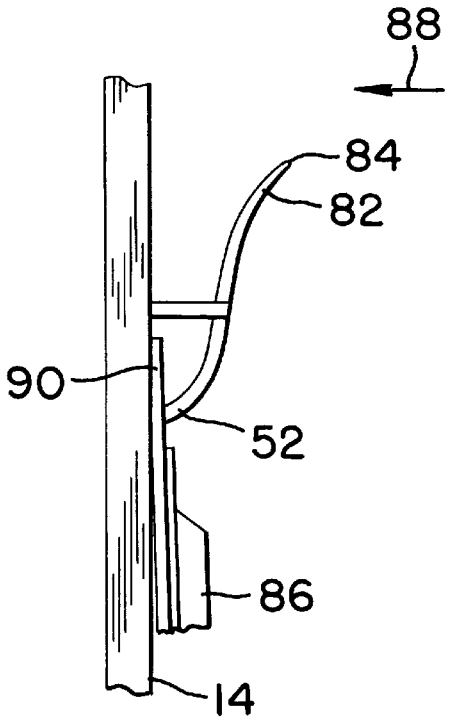
FIG. 8 is a side elevational view of the clip strip of FIG. 1, showing the apparatus in use with the lower edge of the clip strip clamping the merchandise.

During use the upper portion 56 of the clip member 12 can be used to display various types of merchandise such as merchandise 74 in blister card packages which have an aperture 76 proximate to the upper edge of the card 80 as is shown in FIG. 7. As is shown in FIGS. 1, 7 and 8, the upper portion 56 of the clip member 12 is tapered with a relatively thinner portion 82 at the upper end 84. The tapered portion 56 facilitates installation of the merchandise 74 on the clip strip 10 in an efficient manner.

The clip strip 10 may also be used to display merchandise 86 which does not have an aperture. The end 84 of the clip member 12 is pressed toward the support panel 14 in the direction shown by the arrow 88 in FIG. 8, thereby forcing the end 52 to move away from the support panel 14 and allowing a portion 90 of the merchandise 86 to be slipped under the end 52 as is shown in FIG. 8.

When the end 84 is released the clip member 12 snaps back to the original position and the end 52 bears against the portion 90 of the merchandise 86 and the teeth 54 grip the merchandise 86 in a secure manner. When other end 84 of the spring clip 12 is pressed toward the support panel 14, the flanges 30, 32 prevent bending of the support panel 14 so that even when the support panel 14 is suspended from the hook member 64 and the support panel 14 is otherwise unsupported, pressure against the end 84 of the clip member 12 will cause the support plate 36 to bend, rather than causing the support panel 14 to bend thereby allowing the merchandise 86 to be easily inserted under the end 52 of the clip member 12.

The curved upper edge 84 of the clip member 12 extends beyond the end 24 of the aperture 16 so that continued pressure on the end 84 in the direction shown by the arrow 88 in FIG. 8 will cause the end 84 to bear against portion 40 of the support panel 14. Abutment or bearing of the end 84 of clip member 12 onto the support panel 14 prevents overstressing of support plate 36.

As indicated above, the support panel 14, the support plate 36, the clip member 12 and the flanges 30, 32 are formed as a unitary member. The preferred material is a moldable plastic such as Nylon or a similar material.

The support plate 36 in combination with the concave formation of the upper portion 56 of the clip member 12 allows the upper end 84 of the clip member 12 to be spaced away from the support panel 14 thereby allowing the merchandise 74 to be hooked onto the upper end 82 as is shown in FIG. 7 in a rapid and efficient manner.

Figure 4:
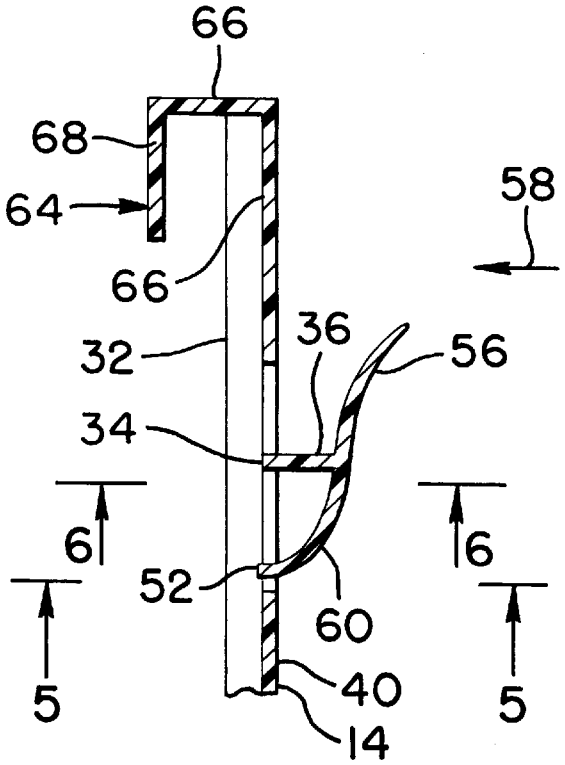
FIG. 4 is a fragmentary cross-sectional view taken along line 4—4 in FIG. 2.
Figure 5:
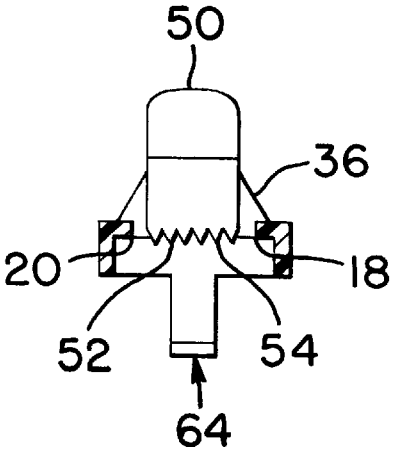
FIG. 5 is a cross-sectional view taken along line 5—5 of FIG. 4.
Figure 6:
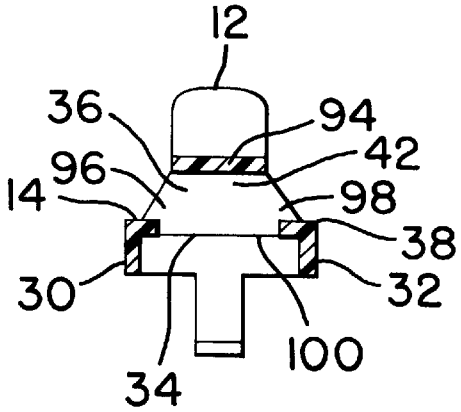
FIG. 6 is a cross-sectional view taken along line 6—6 of FIG. 4.

As is shown in FIG. 4, in the unflexed and unstressed state, the end 52 of the clip member 12 protrudes below the surface 40 of the support panel 14. The clip member 12 always tends to return to this unstressed state, thereby holding the merchandise 86 securely against the support panel 14. In addition, in the position shown in FIG. 4, the edge 52 which when in use contacts the merchandise 86 is free of the support panel 14 and the entire spring clip 10 is free of any small crevices or spaces which would prevent easy cleaning. The unitary structure of the see-saw spring clip 10 allows it to be completely immersed in cleaning solution for rapid and efficient cleaning.

The support plate 36 is generally rectangular in configuration and preferably is trapezoidal in configuration with a relatively shorter edge 94 connected to the clip member 12 and end portions 96, 98 of a relatively longer edge 100 connected to the support panel 14. A relatively smaller area associated with the end portions 96, 98 in contrast to the relatively larger area associated with edge 94 allows preferential bending of the support plate 36 to occur at the end portions 96, 98 when the end 84 is pressed.

It should be understood that while only selected clip members 12 have been described in detail, each of the clip members 12 shown in the drawings has the same configuration as the clip members 12 which have been described.

The foregoing specific embodiment of the present invention is for illustrative purposes only. Various deviations and modifications can be made within the spirit and scope of this invention, without departing from a main theme thereof.

I claim:

1. A clip strip comprising:

an elongated support panel having a first end, a second end, a first edge, a second edge and a first planar surface, with said first planar surface having at least one aperture;

a flexible planar support mounted on said first planar surface of said support panel and having a trapezoidal shape with an upper edge and a lower edge, said upper edge being parallel to said lower edge and having a length less than a length of said lower edge, said lower edge disposed spanning said aperture;

at least one clip member with said clip member having a first end, an intermediate portion, a second end, a first portion disposed between said first end of said clip member and said intermediate portion and a second portion disposed between said intermediate portion and said second end of said clip member with said first end of said clip member disposably spaced away from said flexible planar support, with said intermediate portion mounted to said upper edge of said flexible planar support, with said second end of said clip member disposably projecting into said aperture, and with said second end of said clip member projecting below said first planar surface of said elongated support panel.

2. The clip strip as claimed in claim 1, wherein said second end of said clip member has a plurality of teeth.

3. The clip strip as claimed in claim 1, wherein said first end of said clip member comprises a tapered portion.

4. The clip strip as claimed in claim 1, wherein said flexible planar support is disposed generally perpendicular to said first planar surface of said support panel.

5. The clip strip as claimed in claim 1, wherein said aperture has a straight lower edge and said second end of said clip member is disposed proximate to said lower edge of said aperture.

6. The clip strip as claimed in claim 1, wherein said first portion of said clip member is concave.

7. The clip strip as claimed in claim 1, wherein said second portion of said clip member is convex.

8. The clip strip as claimed in claim 1, wherein said first end of said clip member is rounded.

9. The clip strip as claimed in claim 1, further comprising:

a hook disposed on said first end of said support panel.

10. The clip strip as claimed in claim 1, further comprising:

a flange disposed on said first edge and a flange disposed on said second edge of said elongated support panel.

11. The clip strip as claimed in claim 1, further comprising connector means disposed on said first end of said elongated support panel for connecting said clip strip to another said clip strip.

12. The clip strip as claimed in claim 1, wherein said clip strip is formed as a unitary molded structure.

13. The clip strip as claimed in claim 1, further comprising:

a plurality of said aperture formed in a linear array in said support panel;

a plurality of said planar support with each said planar support disposed spanning a respective one of said apertures; and a plurality of said clip member, with each said intermediate portion of said clip members mounted on a respective one of said planar supports.

* * * * *